US006220961B1

(12) United States Patent
Keane et al.

(10) Patent No.: US 6,220,961 B1
(45) Date of Patent: Apr. 24, 2001

(54) MULTI-LEVEL LOTTERY-TYPE GAMING METHOD AND APPARATUS

(75) Inventors: Martin Keane, Chicago, IL (US); Clifton E. Lind; Gordon Thomas Graves, both of Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 0 days.

(21) Appl. No.: 09/296,909

(22) Filed: Apr. 22, 1999

(51) Int. Cl.[7] ..... A63F 9/00
(52) U.S. Cl. ..... 463/16; 463/12; 463/13
(58) Field of Search ..... 463/13–20, 25.12; 379/93.13

(56) References Cited

U.S. PATENT DOCUMENTS

| | | | | |
|---|---|---|---|---|
| 4,494,197 | | 1/1985 | Troy et al. . | |
| 4,652,998 | * | 3/1987 | Koza et al. | 463/26 |
| 5,042,809 | | 8/1991 | Richardson . | |
| 5,092,598 | | 3/1992 | Kamille . | |
| 5,324,035 | * | 6/1994 | Morris et al. | 463/42 |
| 5,407,199 | | 4/1995 | Gumina . | |
| 5,628,684 | * | 5/1997 | Bouedec | 463/17 |
| 5,868,618 | * | 2/1999 | Netley et al. | 463/13 |
| 5,871,398 | * | 2/1999 | Schneier et al. | 463/16 |
| 6,024,640 | * | 2/2000 | Walker et al. | 463/17 |

* cited by examiner

*Primary Examiner*—Mark Sager
*Assistant Examiner*—John M Hotaling
(74) *Attorney, Agent, or Firm*—Russell D. Culbertson; Shaffer & Culbertson, LLP

(57) ABSTRACT

A lottery-type game is played with a first level game and at least one second level or additional level game. The first level game includes a plurality of first level game records, each having an associated outcome. At least one outcome is a negotiable outcome. The second level game is related to the negotiable outcome of the first level game and includes a plurality of second level game records. According to the present gaming method, a player is enabled to view a first level game representation associated with a particular one of the first level game records. This first level game representation indicates the outcome associated with the particular first level game record. When this first level outcome is the negotiable outcome, the player may choose to view a second level game representation which indicates the outcome of a particular one of the second level game records.

24 Claims, 12 Drawing Sheets

POTENTIAL OUTCOMES FOR FIRST LEVEL GAME

| OUTCOME TYPE | FIRST LEVEL GAME REPRESENTATION (HAND ON INITIAL DEAL) | PAYOUT (FIRST FIVE CARDS) | FIRST LEVEL GAME REPRESENTATION (HAND AFTER DRAW) | PAYOUT (AFTER THE DRAW) |
|---|---|---|---|---|
| IMMEDIATE WINNING OUTCOME | STRAIGHT | 8 | NO DRAW ALLOWED | N/A |
| | FLUSH | 10 | NO DRAW ALLOWED | N/A |
| | FULL HOUSE | 15 | NO DRAW ALLOWED | N/A |
| | FOUR OF A KIND | 1000 | NO DRAW ALLOWED | N/A |
| | STRAIGHT FLUSH | 1000 | NO DRAW ALLOWED | N/A |
| | ROYAL FLUSH | 10000 | NO DRAW ALLOWED | N/A |
| AFTER DRAW WINNING OUTCOME | LESS THAN JACKS | NONE | STRAIGHT | 3 |
| | | NONE | FLUSH | 4 |
| | | NONE | FULL HOUSE | 8 |
| | | NONE | FOUR OF A KIND | 100 |
| | | NONE | STRAIGHT FLUSH | 100 |
| | | NONE | ROYAL FLUSH | 1000 |
| LOSING OUTCOME | LESS THAN JACKS | 0 | LESS THAN JACKS | 0 |
| NEGOTIABLE WINNING OUTCOME | JACKS OR BETTER | 2 | DRAW ENTERS A SECOND LEVEL GAME, SEE FIGURE 2B | |
| | TWO PAIR | 3 | | |
| | FOUR CARD STRAIGHT | 1 | | |
| | FOUR CARD FLUSH | 1 | | |
| | THREE OF A KIND | 5 | | |

*FIG. 2A*

POTENTIAL OUTCOMES FOR SECOND LEVEL GAMES:

-DRAW TO JACKS OR BETTER
-DRAW TO TWO PAIR
-DRAW TO FOUR CARD STRAIGHT
-DRAW TO FOUR CARD FLUSH
-DRAW TO THREE OF A KIND

| OUTCOME TYPE | SECOND LEVEL GAME REPRESENTATION (HAND AFTER DRAW) | PAYOUT AFTER THE DRAW |
|---|---|---|
| WINNING OUTCOME | STRAIGHT | 3 |
| | FLUSH | 4 |
| | FULL HOUSE | 8 |
| | 4 OF A KIND | 100 |
| | STRAIGHT FLUSH | 100 |
| | ROYAL FLUSH | 1000 |
| | JACKS OR BETTER | 1 |
| | TWO PAIR | 2 |
| | 3 OF A KIND | 3 |
| LOSING OUTCOME | 4 CARD STRAIGHT | 0 |
| | 4 CARD FLUSH | 0 |
| | LESS THAN JACKS | 0 |

*FIG. 2B*

| BEAT THE DEALER WITH (OUTCOME) | PRIZE VALUE | NUMBER PER POOL | TOTAL | NUMBER PER BOOK |
|---|---|---|---|---|
| 12, 13, or 14 | $1 | 150000 | $150,000 | 750 |
| 15 | $2 | 20000 | $40,000 | 100 |
| 16 | $3 | 15000 | $45,000 | 75 |
| 17 | $4 | 10000 | $40,000 | 50 |
| 18 | $5 | 10000 | $50,000 | 50 |
| 19 | $10 | 10000 | $100,000 | 50 |
| 20 | $50 | 1000 | $50,000 | 5 |
| 21 | $100 | 1000 | $100,000 | 5 |
| BLACK JACK ANY BUT AK | $1,000 | 100 | $100,000 | 0.5 |
| BLACK JACK AK | $10,000 | 10 | $100,000 | 0.05 |
| | | | | |
| TOTALS | | 217,110 | $775,000 | |

BLACK JACK FIRST LEVEL

*FIG. 4A*

| BEAT THE DEALER WITH (OUTCOME) | PRIZE VALUE | NUMBER PER POOL | TOTAL | NUMBER PER BOOK |
|---|---|---|---|---|
| 16 | $3 | 4,600 | $13,800 | 23 |
| 17 | $4 | 4,600 | $18,400 | 23 |
| 18 | $5 | 4,600 | $23,000 | 23 |
| 19 | $10 | 4,600 | $46,000 | 23 |
| 20 | $50 | 4,600 | $230,000 | 23 |
| 21 | $100 | 4,600 | $460,000 | 23 |
| | | | | |
| TOTALS | | 27,600 | $791,200 | |

BLACK JACK DRAW TO WINNING PLAYER'S HAND OF 15

*FIG. 4B*

| BEAT THE DEALER WITH (OUTCOME) | PRIZE VALUE | NUMBER PER POOL | TOTAL | NUMBER PER BOOK |
|---|---|---|---|---|
| 19 | $10 | 5,000 | $50,000 | 25 |
| 20 | $50 | 5,000 | $250,000 | 25 |
| 21 | $100 | 5,000 | $500,000 | 25 |
| TOTALS | | 15,000 | $800,000 | |

BLACK JACK DRAW TO WINNING PLAYER'S HAND OF 18

*FIG. 4C*

| DEALT HAND | NOMINAL VALUE OF HAND | EXPECTED VALUE OF PRIZE | FREQUENCY HANDS PER POOL | EXPECTED VALUE EXTENSION | % OF TOTAL RETURN | FORCED HOLD | FREQUENCY |
|---|---|---|---|---|---|---|---|
| Royal Flush | $250 | $250.00 | 4 | $1,000 | 0.04% | 1 | 4 |
| St Flush | $50 | $50.00 | 36 | $1,800 | 0.08% | 1 | 36 |
| 4 Kind | $25 | $25.00 | 624 | $15,600 | 0.65% | 1 | 624 |
| 4 Card Royal | | $7.29 | 476 | $3,740 | 0.15% | 1 | 476 |
| Full House | $9 | $9.00 | 3,744 | $33,696 | 1.14% | 1 | 3744 |
| Flush | $6 | $6.00 | 5,000 | $30,000 | 1.26% | 1 | 5000 |
| 3 Kind | $3 | $4.20 | 49,750 | $208,950 | 8.77% | 1 | 49750 |
| Straight | $4 | $4.00 | 10,200 | $40,800 | 1.171% | 1 | 10200 |
| 4 Card St Flush | | $3.40 | 1,153 | $3,920 | 0.16% | 1 | 1153 |
| Two Pair | $2 | $2.60 | 119,220 | $309,972 | 13.01% | 1 | 119220 |
| Jacks Better | $1 | $1.50 | 325,000 | $487,500 | 20.47% | | |
| 3 Card Royal | | $1.00 | 30,000 | $30,000 | 1.26% | | |
| 4 Card Flush | | $1.25 | 110,000 | $137,500 | 5.77% | | |
| Low Pair | | $0.75 | 750,000 | $562,500 | 23.61% | | |
| 4 Card Straight | | $0.75 | 3,200 | $2,400 | 0.10% | | |
| 3 Card St. Flush | | $0.50 | 260,000 | $130,000 | 5.46% | | |
| 2 Card Royal | | $0.50 | 350,000 | $175,000 | 7.35% | | |
| High Card(s) | | $0.50 | 250,000 | $125,000 | 5.25% | | |
| Zilch | | $0.25 | 331,593 | $82,898 | 3.48% | | |
| Total | | | 2,600,000 | $2,382,006 | 100.00% | | 190207 |
| Pool Size | | | 2,600,000 | | | | |
| Total Revenue | | | | $2,600,000 | | | 7.32% of Hands Forced |
| % Return | | | | 91.62% | | | |

*FIG. 5*

PRIZE STRUCTURE FOR DRAW POKER

| HAND | 1 COIN | 2 COINS | 3 COINS | 4 COINS | 5 COINS |
|---|---|---|---|---|---|
| ROYAL FLUSH | 250 | 500 | 750 | 1000 | $4,000 |
| ST FLUSH | 50 | 100 | 150 | 200 | $250 |
| 4 KIND | 25 | 50 | 75 | 100 | $125 |
| FULL HOUSE | 9 | 18 | 27 | 36 | $45 |
| FLUSH | 6 | 12 | 18 | 24 | $30 |
| 3 KIND | 3 | 6 | 9 | 12 | $15 |
| STRAIGHT | 4 | 8 | 12 | 16 | $20 |
| TWO PAIR | 2 | 4 | 6 | 8 | $10 |
| JACKS BETTER | 1 | 2 | 3 | 4 | $5 |

PAYOUT TABLE FOR DRAW POKER

*FIG. 6*

| FINAL HAND | FREQUENCY HANDS PER POOL | VALUE OF HAND | EXTENSION | % OF TOTAL RETURN |
|---|---|---|---|---|
| Royal Flush | | 250 | $0 | 0.00% |
| St Flush | | 50 | $0 | 0.00% |
| 4 Kind | 49 | 25 | $1,225 | 4.25% |
| Full House | 180 | 9 | $1,620 | 5.61% |
| Flush | | 6 | $0 | 0.00% |
| 3 Kind | 2,050 | 3 | $6,150 | 21.31% |
| Straight | | 4 | $0 | 0.00% |
| Two Pair | 2,900 | 2 | $5,800 | 20.10% |
| Jacks or Better | 14,060 | 1 | $14,060 | 48.73% |
| Zilch | | 0 | $0 | |
| | | | | |
| Total | 19,239 | | $28,855 | 100.00% |
| Expected Value | | | $1,500 | |

DRAW TO JACKS OR BETTER
SECOND LEVEL GAME PRIZE STRUCTURE (1 COIN)

*FIG. 8*

| FINAL HAND | FREQUENCY HANDS PER POOL | VALUE OF HAND | EXTENSION | % OF TOTAL RETURN |
|---|---|---|---|---|
| Royal Flush | | 250 | $0 | 0.00% |
| St Flush | | 50 | $0 | 0.00% |
| 4 Kind | | 25 | $0 | 0.00% |
| Full House | | 9 | $0 | 0.00% |
| Flush | 1200 | 6 | $7,200 | 100.00% |
| 3 Kind | | 3 | $0 | 0.00% |
| Straight | | 4 | $0 | 0.00% |
| Two Pair | | 2 | $0 | 0.00% |
| Jacks or Better | | 1 | $0 | 0.00% |
| Zilch | 4560 | 0 | $0 | 0.00% |
| | | | | |
| Total | 5760 | | $7,200 | 100.00% |
| Expected Value | | | $1,250 | |

DRAW TO 4 CARD FLUSH
SECOND LEVEL GAME PRIZE STRUCTURE (1 COIN)

*FIG. 9*

MULTI-LEVEL LOTTERY-TYPE GAMING METHOD AND APPARATUS

TECHNICAL FIELD OF THE INVENTION

This invention relates to games of chance and, more particularly, to lottery-type games which provide for greater player participation. The invention encompasses a gaming method, an apparatus through which the game may be played, and a program product for implementing the game.

BACKGROUND OF THE INVENTION

Lottery-type games are popular sources of revenue for governmental agencies and charitable organizations. As used in this disclosure, a "lottery-type game" comprises a game having a predetermined number of payouts or prizes and a determined chance of winning. For example, a lottery-type game may comprise a scratch-off or pull tab game having a number of pre-printed tickets. Each ticket has some type of printed outcome indicator which indicates if the particular ticket is a winning ticket and, if the ticket is a winning ticket, indicates the prize or payout. The outcome indicator is commonly covered with some opaque cover material which may be scratched off or otherwise removed to reveal the outcome indicator. Thus, the ticket purchaser cannot see if the ticket is a winning ticket until purchasing the ticket and removing the opaque cover material.

Prior lottery-type games suffer from the fact that the games require no player involvement other than simply uncovering the outcome indicator to find the predetermined prize or payout. Thus, prior lottery-type games lack the player excitement generated in casino-type games of chance such as draw poker and black jack, for example, which require active player participation and some level of player skill.

In recognition of this disadvantage of lottery-type games, some of these games are made to resemble casino-type games. For example, each outcome indicator on a scratch-off game may comprise a representation of a draw poker hand. Winning tickets in this type of scratch-off game may include an outcome indicator which represents a traditional winning poker hand such as a straight, flush, or full house, for example. These lottery-type games use illustrations related to casino-type games in an effort to create a sense of excitement in the lottery-type game similar to the excitement associated with the depicted casino-type game. However, in spite of these illustrations in lottery-type games, the games remain essentially passive, with little player involvement.

SUMMARY OF THE INVENTION

It is an object of the invention to provide a gaming method which provides for greater player involvement while maintaining the predetermined chances of winning and readily verifiable, predetermined payouts which are characteristic of lottery-type games.

A gaming method according to the invention utilizes a first level game and at least one second level or daughter game. Each game at a particular level comprises a separate lottery type game having a number or plurality of game records. Each game record includes a predetermined outcome. Thus, for example, the first level game includes a plurality of first level game records and each first level game record includes a first level game outcome.

Some forms of the invention include additional level games in addition to the first and second level games. Also, some forms of the invention may include several different second level games or several different games at a particular additional level. Regardless of the number of game levels and the number of different games at each particular level, each game at a particular level comprises a separate lottery-type game.

Each game record according to the invention may be embodied in a ticket such as a scratch-off ticket, or may be embodied in a data structure, such as a data structure maintained on a computer readable medium. Each game outcome represents the outcome associated with the particular game record. For example, the game outcome associated with a particular game record may comprise a winning outcome which is associated with a prize or payout, or may comprise a losing outcome not associated with any prize or payout. The game records for each game level according to the invention may be developed by any suitable means including prior art means for generating or manufacturing lottery-type games.

According to the invention, the first level game has at least one first level game record which includes an outcome representing a first level negotiable outcome. A second level game is related to the first level negotiable outcome in that participation in that particular second level game is possible only if a player receives the first level negotiable outcome in the first level game. As used in this disclosure and the accompanying claims the phrase "negotiable outcome" means that the associated game record entitles the receiving player to participate in a next level game. Also, a negotiable outcome may, in some forms of the invention, entitle the receiving player to participate in any one of several different next level games.

In the course of play, a player is enabled to view a first level game representation associated with a particular first level game record. For example, the first level game representation may comprise some printed indicia on a scratch-off ticket and the player is enabled to view the first level game representation by receiving the game record, that is, the scratch-off ticket, and by removing an opaque cover from the scratch-off ticket. Alternatively, the first level game representation may be some graphic representation displayed on a player terminal in response to a first level play request which the player has entered through the terminal. In this latter case, the player receives the associated game record through the terminal and is enabled to view the first level game representation when the terminal displays the game representation. In any event, the first level game representation may include some representation related to a traditional casino-type game. The first level game representation may, for example, comprise a graphical representation of a draw poker hand or a blackjack hand.

When a player is enabled to view a first level game representation associated with the first level negotiable outcome, the player may participate in the second level game related to the first level negotiable outcome. In some cases the received first level game record may be associated with a predetermined prize or payout. In these cases the player has a choice of "cashing in" for the currently indicated payout or participating in a second level game. However, in some implementations of the invention, each first level game record is associated with an expected value and not necessarily a current value or payout. The expected value is related to the potential payouts in a second level game.

To participate in the second level game, the player makes a second level play request which enables the player to view a second level game representation associated with a particular second level game record. The second level play request may comprise the act of scratching off an opaque covering where the game records are embodied in scratch-off tickets, or may comprise providing some terminal input where the game representations are displayed through a player terminal. Regardless of how the player is enabled to view the second level game representation, the game representation is associated with a particular second level game outcome and second level game record. The outcome may comprise a second level winning outcome having some associated payout, or may comprise a second level losing outcome having no associated prize or payout. According to the invention, the second level game representation includes a representation portion in common with the first level game representation.

Where the received second level game record is associated with a second level negotiable outcome, the player may participate in an additional level game. The player participates in the additional level game by making an additional play request by suitable means depending upon the particular implementation of the invention.

These interrelated game levels according to the invention facilitate greater player participation in the games. Each game, however, remains strictly a lottery-type game with a predetermined payout or prize for each game record, similar to the predetermined prize or payout for each ticket of a traditional scratch-off or pull tab game. Thus, the games are readily verifiable and avoid the variability in total payout which is characteristic of casino-type games. Yet the game representations associated with each game record according to the invention may be related to a casino-type game so that it appears to the player that they are participating in a casino-type game rather than a lottery-type game.

In the preferred form of the invention, the game records are implemented as electronic data structures and the associated game representations are displayed on a player terminal. In addition to a suitable display, the terminal includes a player input device which enables the player to make game play requests and perhaps other types of inputs. A communication arrangement is included in the apparatus for facilitating communications between the player terminal and a game record storage device which stores the game records.

In this electronic form of the invention, the player terminal has associated with it a play control arrangement for controlling the play of the game. The play control arrangement may comprise software instructions executed on a processor at the terminal or a processor associated with the terminal. This play control software includes first level game code which causes the player terminal to display a first level game representation in response to a first level play request initiated by the player at the player terminal. Second level game program code included in the game control software causes the player terminal to respond to a second level play request if the outcome of the particular first level game record associated with the game representation comprises the first level negotiable outcome. The terminal responds to such a game play request by displaying a second level game representation associated with a particular second level game record.

In the electronically implemented form of the invention, the game representations may be created in several different ways. For example, each game record may include a game representation comprising software instructions for producing a desired graphic display at the player terminal. In this case, the game representation is transferred to the terminal in response to a game play request. Alternatively, the game representations may be generated by information derived from the outcome associated with a particular game record, or may be generated from other information included in the game record. In this latter case, the terminal has associated with it a game representation generation arrangement which may comprise software adapted to generate instructions to produce a particular graphic display.

The player terminal type implementation of the invention provides additional opportunity for making a single level of the present gaming method have the appearance of a casino-type game. For example, an outcome associated with a particular game record may be a winning outcome which does not entitle the player to participate in the next level game, but still provides the appearance of requiring additional player participation. As applied to a poker related game, a player may receive a game record which causes the terminal to display a poker hand which does not indicate a winning outcome even though the record is, in fact, associated with a winning outcome. In response to a player input, the terminal may modify the display such as by drawing additional cards and/or by showing the dealer's hand. This modified display or game representation will indicate the particular winning outcome associated with the game record which the player has already received.

These and other objects, advantages, and features of the invention will be apparent from the following description of the preferred embodiments, considered along with the accompanying drawings.

BRIEF DESCRIPTION OF THE DRAWINGS

FIG. 2A is a table showing potential outcomes associated with a first level game in a preferred implementation of the invention.

FIG. 2B is a table showing potential outcomes associated with a set of second level games related to outcomes in FIG. 2A.

FIG. 4A is a table showing the payout for a first level game in which the game representations are associated with a black jack game.

FIG. 4B is a table showing the payout for a second level game related to one negotiable outcome of the first level game shown in FIG. 4A.

FIG. 4C is a table showing the payout for a third level game related to one negotiable outcome of the second level game shown in FIG. 4B.

FIG. 5 is a table showing the prize structure for an alternate multi-level lottery-type game according to the invention.

FIG. 6 is a payout table for the game shown in FIG. 5.

FIG. 8 is a table showing potential outcomes for one second level game used in the gaming method of FIG. 7.

FIG. 9 is a table showing potential outcomes for another second level game used in the method set out in FIG. 7.

DESCRIPTION OF THE PREFERRED EMBODIMENTS

Figure 1:
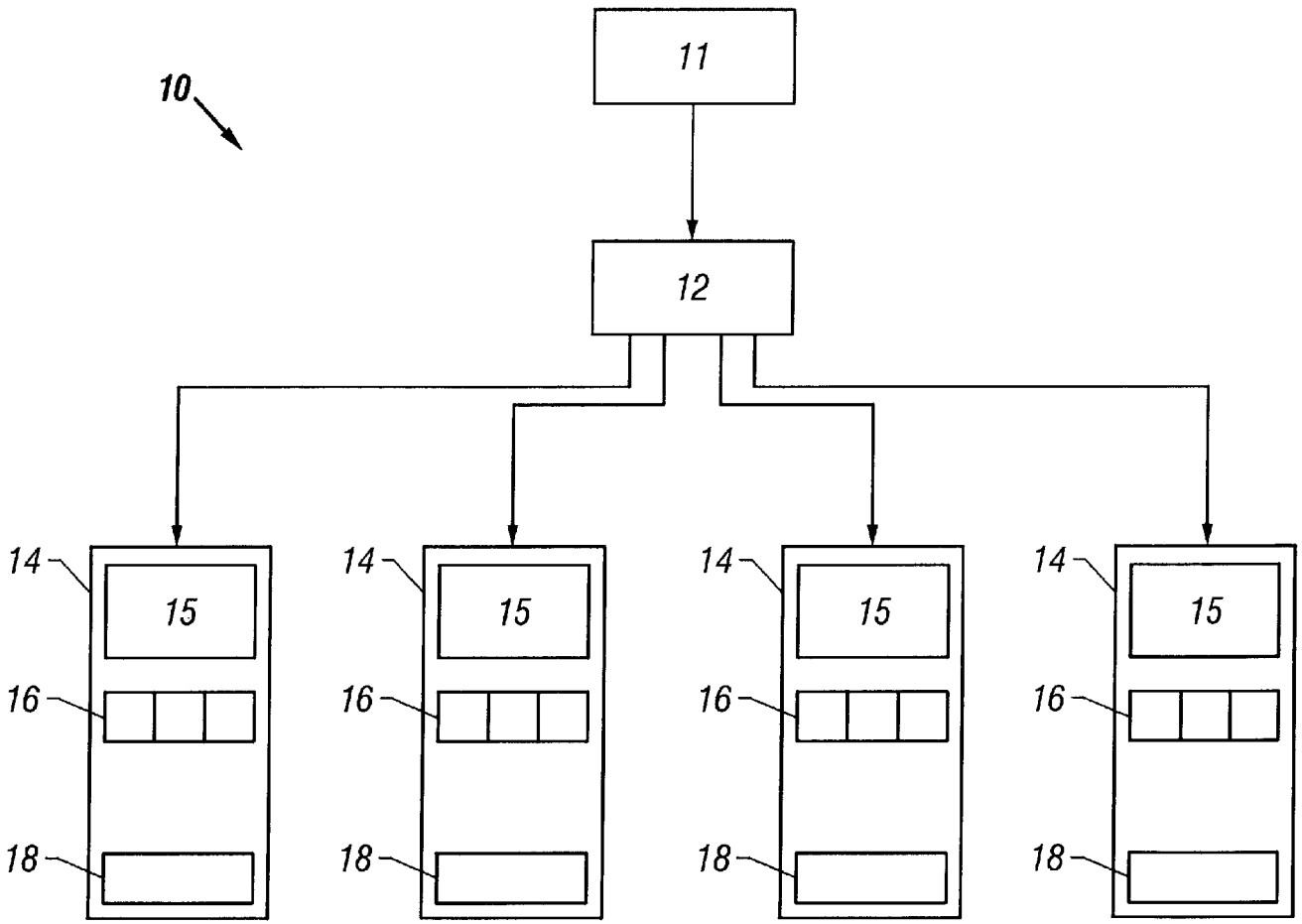
FIG. 1 is a diagrammatic representation of a gaming apparatus embodying one preferred form of the invention.

FIG. 1 shows a gaming apparatus 10 embodying the principles of the invention. The form of the invention shown in FIG. 1 is adapted to implement a gaming method illustrated in FIGS. 2A, 2B, and 3. As will be discussed with particular reference to FIGS. 2A, 2B, and 3, the gaming method employs at least two different lottery-type games. Each game is played with a number or plurality of game records, which in this implementation of the invention, each comprise electronic data structures.

The game records are created at a game manufacturing computer system 11 and then stored in a storage device associated with a central computer system 12. Central computer system 12 is connected to communicate via suitable means with a plurality of player terminals 14. Although four player terminals 14 are shown in FIG. 1 for purposes of illustrating the invention, any number of player terminals may be included in an apparatus embodying the principles of the invention.

Each player terminal 14 includes a display 15 for displaying various game representations, and further includes an input device 16 for receiving player inputs including game play requests. The input device may comprise any type of input arrangement including one or more push button, key, or lever activated switches. Also, the input device may comprise a touch screen and thus be integrated with the display 15. Although not shown in the drawings, each player terminal 14 may also include an arrangement for receiving payments from a player and an arrangement for making payouts to the player.

The player terminals 14 shown in FIG. 1 also include a processor 18 for executing game control software which implements the gaming method of the invention. Other forms of the invention may perform some or all of this game play processing at a central computer system such as system 12. The invention is not limited to any particular processing arrangement, and any processing arrangement which performs the gaming method described in this disclosure is to be considered an equivalent to the illustrative processing arrangement shown in FIG. 1.

Game records for the different games used in the invention may be generated by any suitable means. For example, once a desired quantity of each potential outcome is determined for a particular game, that number of game records for each outcome may be generated by a suitable method. Each record includes some information which indicates, or may be used to indicate, if the particular record is a winning or losing record. That is, each record includes some means for indicating a particular outcome associated with the record. For example, each record may include a record identifier, an outcome, and a game representation. Alternatively, each game record may include only a record identifier. In this latter form of game record, the outcome and perhaps other information associated with the record may be maintained in separate tables or other data structures which are accessed using the game record identifier. Regardless of how the game records for each game are manifested, once the records are generated, they may be shuffled or otherwise randomized electronically in a separate randomization step. Both the game record generation and randomization may be performed at a separate game manufacturing system such as system 11 shown in FIG. 1.

The randomized game records may be arranged in groups, and groups of randomized game records may be transferred for distribution or sale to one or more separate computer systems such as the central computer system 12 shown in FIG. 1. These groups of randomized game records are analogous to books of scratch-off tickets distributed to lottery retailers. As will be discussed in detail below with reference to FIGS. 2A, 2B, and 3, the randomized game records for each game are distributed sequentially to the various player terminals 14. This sequential distribution is analogous to the distribution of scratch-off tickets by a retailer. In the illustrated form of the invention, central computer 12 includes a storage device such as a hard drive (not shown separately) for storing the game records required in a particular implementation of the invention. Central computer 12 may also include programming for performing various accounting and verification functions associated with the play of the game.

Those skilled in the art will appreciate that the invention may be embodied in many arrangements other than the illustrative arrangement shown in FIG. 1. For example a single computer system may generate the game records according to the invention and may also store the game records for distribution to several player terminals such as terminals 14. Alternatively, a single computer system could perform the game record generation function, the game record storage function, and player interaction function, thus replacing the separate systems 11, 12, and 14 shown in FIG. 1. These alternative arrangements are to be considered equivalent to the arrangement shown in FIG. 1. Furthermore, rather than randomizing an entire set of game records and then distributing the records sequentially, the game records could be drawn randomly and distributed from a sequentially arranged set of records. This alternative game record randomization technique is to be considered within the scope of the invention as set forth in the following claims.

Figure 3:
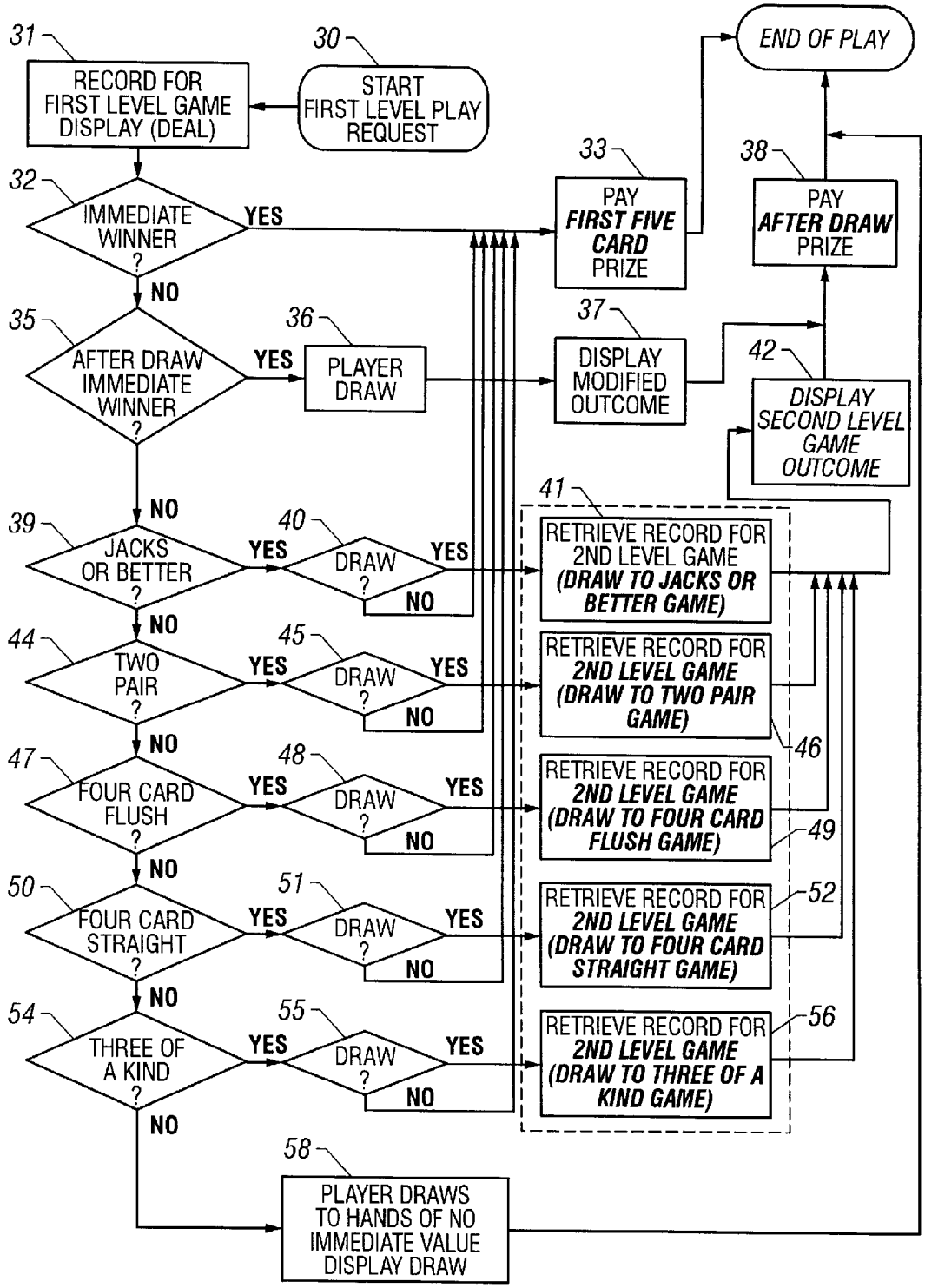
FIG. 3 is a flow chart illustrating a gaming method embodying the principles of the invention and using the set of games shown in FIGS. 2A and 2B.

FIGS. 2A, 2B, and 3 may be used to describe a gaming method according to the invention which may be implemented through the apparatus 10 shown in FIG. 1. FIGS. 2A and 2B list the potential outcomes and associated game representations of a set of first and second level games. FIG. 3 shows the process steps performed in the illustrative gaming method. In this form of the invention, the gaming method employs two game levels to imitate a traditional draw poker casino-type game. Each game representation comprises a representation of five poker cards. This particular gaming method does not employ game representations which include a representation of a dealer's hand. However, the gaming method may be modified easily to give the player the appearance of playing against a dealer.

The gaming method shown in FIG. 3 employs a single first level game, and five separate second level games. As shown in FIG. 2A, each game record of the first level game is associated with one of four potential outcomes, an immediate winning outcome, an after draw winning outcome, a negotiable outcome, and a losing outcome. The first level game may be referred to as the "initial deal" game. The five second level games shown in FIG. 2B are entitled "draw to jacks or better," "draw to two pair," "draw to four card straight," "draw to four card flush," and "draw to three of a kind."

Referring now to FIG. 3, the gaming method starts with an initial player request shown at reference numeral 30. The initial player request may comprise a first level play request which the player enters through input device 16 associated with a particular terminal 14 shown in FIG. 1. Commonly the player will be required to make a payment in some manner through terminal 14 in order to enable the terminal to act on the play request. The properly enabled terminal 14 responds to the first level play request at process block 31 in FIG. 3 by fetching or retrieving a particular first level game record from the game record storage device (not shown) which may, for example, be associated with the central computer system 12 in FIG. 1. Display device 15 then displays the first level game representation associated with the particular first level game record which has been retrieved. Displaying the first level game representation at display 15 enables the player to view the first level game representation and thereby determine the outcome associated with the particular record. It will be noted that the particular first level game record retrieved is retrieved sequentially from the game records still available in the particular game. However, the player preferably has no way of knowing how many game records are still available in the first level game or what prizes have already been paid out in the game. For this reason, and by virtue of the fact that the records generated in a game are all associated with a fixed outcome, the first level play request according to the invention is analogous to the purchase of a scratch-off lottery ticket.

The first level outcome associated with the retrieved first level game record may be an immediate winning outcome. For example, the winning outcome may be a straight flush. In this case the first level game representation comprises a graphical representation of a straight flush. This graphical representation was displayed at step 31 after the particular record was retrieved. Since the outcome is an immediate winning outcome, the process branches at block 32 and at block 33 makes the appropriate payout. According to the table shown in FIG. 2A, the payout for a first level immediate winning outcome represented by a straight flush comprises $1000. This payout may be made in any suitable fashion.

Alternatively, the first level outcome associated with the retrieved first level game record fetched at step 31 may comprise an after-draw winning outcome. In this case, the first level game representation displayed at display 15 comprises a graphical representation of a hand having no apparent value, for example, a five card hand having only a pair of "nine" cards. In the case of a retrieved record associated with an after-draw winning outcome, the process shown in FIG. 3 branches that decision box 35, enabling the player to make an input at block 36. In response to this player input at block 36, the gaming method includes displaying a modified game representation comprising some graphical representation of a winning outcome. This displaying step is shown at process block 37 in FIG. 3. For example, after the player input at block 36 the representation shown on display 15 may be modified to show a pair of "nines" which appear to have been held from the initial deal, and three of a kind which appear to have been drawn to produce a full house. After displaying the modified game representation at step 37, the appropriate payout is made at process block 38.

It will be noted that the after-draw winning outcome is still only the outcome of the particular first level game which has been retrieved at block 31. Even though it appears to the player that they have drawn to a full house, the final payout was dictated by the first level outcome associated with the retrieved first level game record. This alter-draw winning case is to be distinguished from the negotiable outcomes which enable the player to participate in a second level game if they so choose.

In the situation where the retrieved first level game record is associated with the outcome "jacks or better," the process at block 31 displays a first level game representation comprising a graphical representation of a five card hand having a pair of jacks, queens, kings, or aces, and then the process branches at decision box 39. This first level negotiable outcome gives the player the choice of drawing or holding at input box 40. If the player does not make an input representing a draw, the process branches to payout block 33 and the system makes the indicated payout, $2 in the example shown in FIG. 2A.

However, at input block 40 the player may enter a second level play request or draw request through input device 16 associated with the terminal 14 (FIG. 1). This second level play request effectively purchases a new record in the second level game "draw to jacks or better" having the potential outcomes "full house," "4 of a kind," "jacks or better," "two pair," and "3 of a kind" shown in FIG. 2B. The purchase is made with the value of the payout which would have been paid at block 33 had the player not made a second level play request at input box 40. The gaming method responds to the second level play request by retrieving a second level game record at process block 41 and, at process block 42, displaying a second level game representation associated with the retrieved second level game record. The process then moves to payout block 38 where the system makes any payout associated with the outcome of the retrieved second level game record. For example, the outcome associated with the second level game record may comprise a full house. In this example the second level game representation comprises a graphical representation of the pair of cards shown in the hand comprising the first level game representation, along with three of the same type of card. Thus, the second level game representation is consistent with the first level game representation and includes a common representation portion, that common portion being the two cards that appear to have been held from the first level game representation. Preferably, the display 15 is operated to make it appear to the player that they have played a draw poker hand and drawn to a full house. However, the player has not truly played a draw poker hand in which individual cards are received at random, but has instead played two related lottery-type games, the second lottery-type game related to the "jacks or better" negotiable outcome of the first lottery-type game.

The process proceeds in the same manner where the outcome associated with the first level game record retrieved at process block 31 comprises one of the other negotiable outcomes. Where the first level outcome comprises two pair, the game representation produced at display 15 comprises a graphical representation of a five card hand including two pair and the process branches at decision block 44 to input block 45. The player may then enter a second level play request through a suitable player input 16 (FIG. 1) to participate in the second level game entitled "draw to two pair." Alternatively, the player may elect to "stand" by not entering a second level play request at 45, causing the process to branch to payout block 33 where the system makes the payout for the "two pair" first level game outcome. Where the second level play request is entered at 45, the method moves to process block 46 and a second level game record is retrieved from the collection of records comprising the "draw to two pair" game. At process block 42, the system displays the second level game representation associated with the outcome of the record retrieved at 46. Finally, any payout associated with the second level game outcome is paid at block 38 and the process ends.

Where the first level game outcome comprises a four card flush, the process branches at decision block 47 and the player may enter a second level play request at input block 48. A second level play request at block 48 causes the process to proceed to block 49 where the system retrieves a second level game record from the second level game entitled "draw to four card flush." From this point the process goes to the display step at block 42 and then the payout step at block 38.

Where the first level game outcome associated with a first level game record retrieved at block 31 comprises a four card straight, the process branches at decision block 50 and the player may enter a second level play request at input block 51. A second level play request at block 51 takes the process to block 52 where the system retrieves a second level game record from the second level game entitled "draw to four card straight." From block 52 the process moves to the display step at block 42 and then the payout step at block 38.

Finally, where the first level game outcome at block 31 comprises the three of a kind outcome, the process branches at decision block 54 and the player may enter a second level play request at input block 55. A second level play request at block 55 causes the process to move to block 56 where the system retrieves a second level game record from the second level game entitled "draw to three of the kind." From block 56 the process moves to the second level game representation display step at block 42 and then the payout step at block 38.

As at block 40, a second level play request or draw request at blocks 45, 48, 51, or 55 is essentially a request to participate in a particular second level game related to the particular negotiable outcome. The cost of participating in the second level game is the value of the first level negotiable outcome. Should the player not enter a second level play request at input blocks 40, 45, 48, 51, or 55, the player forgoes the opportunity to participate in the particular second level game and receives the payout associated with the first level negotiable outcome for the first level game record retrieved at block 31.

The final possible first level game outcome comprises a losing outcome in which the player receives no payout. In this case, the first level game representation displayed at block 31 comprises a graphical representation of a five card poker hand having no value. After displaying the first level game representation, the gaming method passes down through decision blocks 32, 35, 39, 44, 47, 50, and 54 to player input block 58 where the player is allowed to make a draw input and a result is displayed. The first level game outcome retrieved at block 31 dictates that the game representation displayed after the draw input at 58 still comprises a hand of no value. From block 58, the process ends and the player may again enter the first level game at start block 30.

Each game record retrieval step, such as steps 31, 41, 46, 49, 52, and 56 in FIG. 3, is performed by a game play control arrangement comprising first and second game level software code or instructions executed by a processor associated with the gaming apparatus. Similarly, the game representation displaying steps 31, 37, and 42, and decision steps 32, 35, 39, 44, 47, 50, and 54 are performed by software instructions, along with the payout steps 33 and 38.

The game representations themselves may be generated from software instructions included in the respective game records. In this case the software includes retrieval code or instructions for retrieving the game record and executing the retrieved game representation. However, the game representations are more preferably generated from software instructions residing at the displaying device and called by instructions included in the respective game record. In this latter case, the implementing software includes game representation generation code for generating the various game representations based on information in the retrieved game records. These implementations and hybrids of the two are to be considered equivalents for purposes of the following claims. Also, game representation modifications within a single game level, such as a modification made after input block 36 in FIG. 3, are preferably performed by representation modification code included in the code for a particular game level.

Also, the processor which executes the various software instructions for a particular game play comprises the processor 18 included in the respective gaming terminal 14 shown in FIG. 1. Otherwise, the processing steps may be distributed to other processors included in the system such as a processor associated with central computer 12.

It will be apparent from the method set out in FIG. 3, that the invention provides a major advantage over prior lottery-type games, particularly when implemented in a computer-based apparatus such as that shown in FIG. 1. In the computer-based apparatus 10 shown in FIG. 1, the method of the invention may be implemented so that it appears to the player that they are participating in a regular casino-type game in which results are randomized for each individual play and the outcome of each play is uncertain. That is, the various game representations may be designed so that it appears to the player that they are playing casino-type poker, for example. Regardless of this appearance, the player is in fact only participating in one or more lottery-type games each having a fixed set of available game records and each record having a predetermined, readily verifiable outcome.

Alternatively to the electronic or computer-based implementation, the gaming method according to the invention may be implemented by scratch-off or pull tab tickets. Although this implementation does not provide a realistic appearance of playing a casino-type, it does better mimic such a game and may generate more player interest than traditional scratch-off or pull tab games.

In a scratch-off ticket implementation, each scratch-off ticket (not shown) is preprinted with two or more game representations, each game representation associated with a different game record from a particular lottery-type game. Each game representation is obscured by some covering which may be removed to enable a player to view the respective game representation and determine an outcome indicated by the game representation. A player plays the scratch-off ticket embodiment of the invention by purchasing the ticket and removing the covering material to expose the first level game representation. The now exposed first level game representation indicates the first level game outcome. This first level game outcome may comprise a negotiable outcome which enables the player to participate in a second level game. The player may participate in the second level game by removing the covering material to expose the second level game representation. By removing the covering material to expose the second level game representation, the player effectively purchases the second level game record with the value of the first level negotiable outcome. The second level game is in any case, related to the particular negotiable outcome of the first level game. Of course the player may choose not to participate in the second level game and instead collect the prize associated with the first level negotiable outcome.

FIG. 4A shows a payout table for an alternative first level game according to the invention. The particular game illustrated in FIG. 4A is related to a blackjack game. The game is manufactured at a manufacturing system such as computer system 11 in FIG. 1, and includes a total of one million records. The records are separated into subgroups or books of five thousand and these subgroups may be distributed to retailers or retailing machines such as central system 12 in FIG. 1. FIG. 4A shows the total number of each type of winning outcome associated with a first level game record in the pool, the total number of winning outcomes per subgroup, and the aggregate prize value for each type or winning record.

When this form of the invention is implemented in a computer-based system such as that shown in FIG. 1, each first level game representation displayed at the player terminal display 15 for a retrieved first level game record comprises a representation of a blackjack game. For example, a first level game representation may comprise two player cards shown face up along with two dealer cards, one card up and one down card. The outcome associated with each first level record may be a winning outcome having some associated payout, or a losing outcome with no payout. Also at least one winning outcome of the first level game comprises a negotiable outcome which entitles the player to participate in a second level game.

If the outcome associated with a first level game record comprises a losing outcome, the game control arrangement controls the player terminal display 15 (FIG. 1) to show a first level game representation which portrays the losing outcome. The displayed game representation portrays the losing outcome regardless of the action taken by the player to hit or stay through the player input 16 shown in FIG. 1. If the player makes an input requesting one or more additional cards, the representation at display 15 is preferably modified to show that the dealer wins. The dealer may be shown as winning either by beating the player's hand or by having the player break.

When the outcome associated with a particular first level game record is a negotiable outcome and player makes an input indicating that they wish to stay, the game play arrangement controls the display 15 to show a game representation which fits the payout associated with the particular first level record. For example, the game play arrangement may simply make the payout after the original deal. However, in the preferred form of the invention the game play arrangement modifies the game representation shown on display 15 to show that the player wins. The player may be shown to win by having the dealer break or by having the player's hand beat the dealer's hand.

It will be noted that the initial game representation associated with a particular record may not indicate the final winning outcome associated with the record. For example, a first level game record may be associated with winning outcome of "18" shown in FIG. 4B. However, the initial game representation shown on display 15 may show an "8" for example. After a player input, the game representation shown on display 15 may be changed to show a face card dealt to the player to produce a hand of "18," and to show that the dealer either breaks or ends up with a lower hand. Also, the initial game representation associated with a game record having losing outcome may show that the player has a good hand, such as an "18" for example. After the player stays, however, the game representation will be modified to show that the dealer's hand beats the player's "18" since the retrieved game record dictates the losing outcome. In these illustrations, the first level game representation associated with the particular retrieved first level game record is made up of the two separate representations, the initial game representation and the modified game representation.

In the preferred forms of the invention, the game records which are associated with losing outcomes are constructed to provide a wide variety of game representations for indicating the losing outcomes. This variety of game representations for indicating losing outcomes adds to the realistic appearance of the lottery-type game according to the invention. That is, the variety of losing game representations enables the present game to better imitate the intended casino-type game, and helps maintain player interest.

FIG. 4B shows a second level game entitled "draw to 15" which is related to a negotiable outcome of 15 in the first level game shown in FIG. 4A. When the player participating in the first level game receives a first level game record having the outcome "beat the dealer with 15," the player may choose to participate in the second level game "draw to winning hand of 15." Participation in the second level game "draw to winning hand of 15" is purchased with the payout value of the negotiable outcome "beat the dealer with 15" in the first level game ($2 as shown in FIG. 4A). To participate in the second level game, the player makes a second level play request through the input device 16 (FIG. 1). Of course, the system is preferably implemented so that it does not appear to the player that they are making a request for a second level game record. It may appear to the player that they are simply requesting another card (a hit). In any event, the second level play request input through input device 16 (FIG. 1) causes the system to retrieve a record from the second level game "draw to winning hand of 15" and the second level game representation associated with the retrieved record indicates the outcome associated with the particular second level record. Door example, the particular second level game record may comprise a negotiable outcome of "beat the dealer with 18" in which terminal display 15 is caused to show a "3" card drawn after the original two cards indicated by the first level game record. In this case the second level game representation includes the originally displayed player cards as a common representation portion also included in the first level game representation.

Continuing with this example, the negotiable outcome "beat the dealer with 18" in the second level game enables the player to participate in a third or additional level game. This illustrative third level game is entitled "draw to winning hand of 18" and the payout table for the game is shown in FIG. 4C. As with the second level game, the player may make a play request through a suitable input device (16 in FIG. 1), and this third level play request causes the game control arrangement associated with terminal 14 to retrieve a third level game record from the third level "draw to winning hand of 18" game. This third level game record may be associated with a winning outcome or a losing outcome, and the system displays a third level game representation corresponding to the outcome associated with the particular third level game record.

Thus, as in the poker related form of the invention described above with reference to FIGS. 2A, 2B, and 3, the black jack related game may be implemented on apparatus 10 so as to appear to the player that they are playing a casino-type game. However the player is still only participating in one or more lottery-type games.

An alternate form of the invention may be described with reference to FIGS. 5 through 9. In this alternate embodiment, the game representations are related to a five-card poker game, although it will be understood that the alternate method could be implemented using game representations associated with other games. Regardless of the casino-type game or other game which the invention is intended to mimic, this alternate form of the invention still uses multiple levels of lottery-type games. However, the alternate embodiment uses a single payout table shown in FIG. 6 in contrast to multiple payout tables such as those illustrated in FIGS. 2A and 2B.

As indicated in FIG. 5, each first level game record in the alternate form of the invention is associated with an expected value and a game category. The expected value comprises a value associated with an optimum player response to the first level game record and its associated game representation. The game category is also related to the optimum player response to the first level game record and game representation.

The form of the invention shown in FIGS. 5 through 9 even better mimics the play of a casino-type video poker game. The resemblance between a casino-type video poker game and the alternate multi-level lottery-type game according to invention stems not only from the way in which the game is presented to the player but also from the appearance of the payout table itself. The payout table shown FIG. 6 is very similar to a payout table which is displayed to a player in a casino-type video draw poker game. The payout table in FIG. 6 may also be displayed at the player terminal (14 in Figure) to give the present multi-level lottery-type game the feel of a casino-type video draw poker game. Also, for most hands (game representations) which may be dealt in the first level game, this alternate form of the invention allows the player to hold any subset of cards. Particularly, a player is allowed to hold a subset of cards from the first level game representation even if the chosen subset is not the optimum play for the dealt hand.

Figure 7:
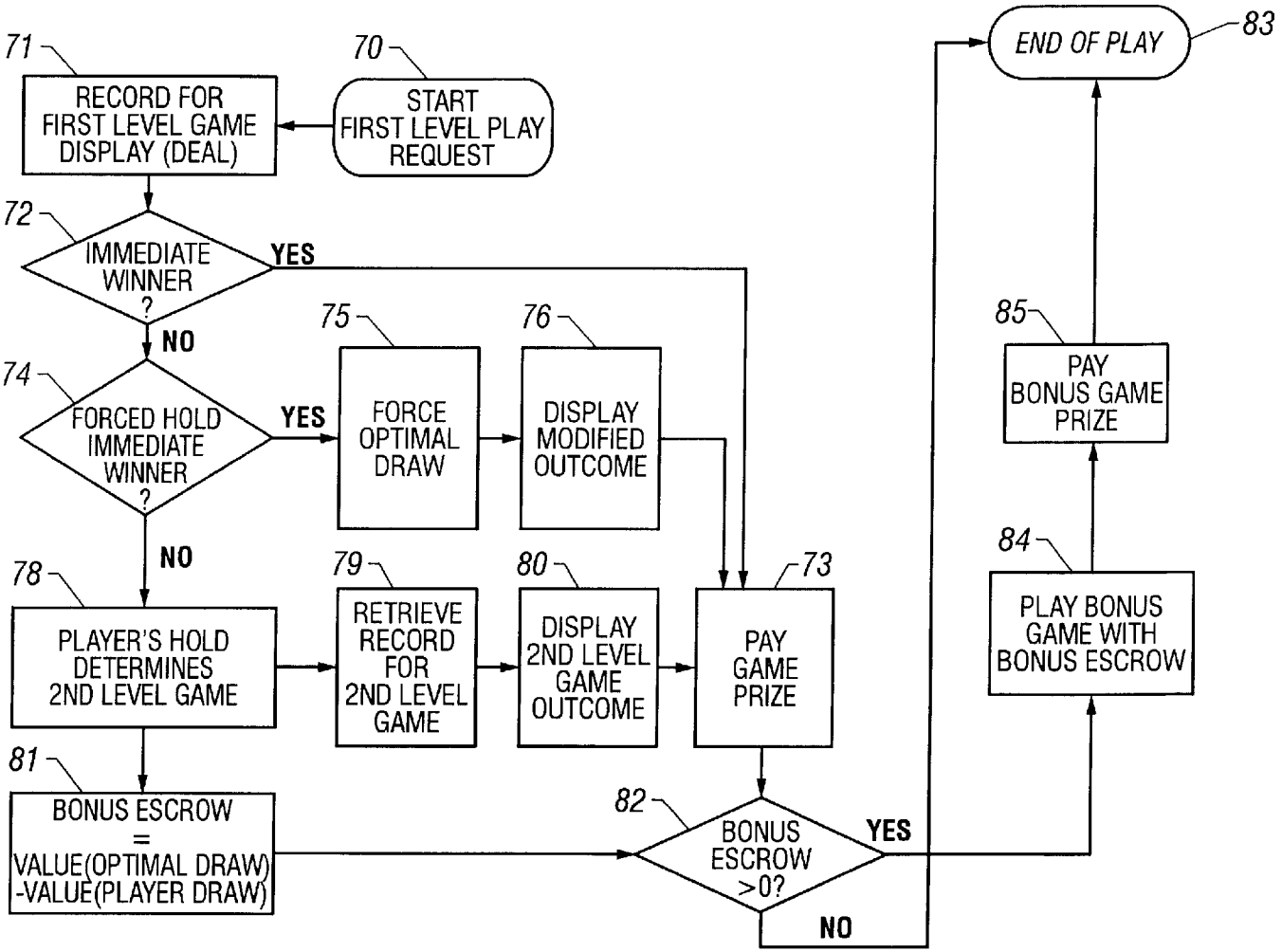
FIG. 7 is a flow chart showing a gaming method which uses the prize structure and payout table shown in FIGS. 5 and 6.

The alternate gaming method may be described with particular reference to the flow chart shown in FIG. 7. The game may be played on a gaming apparatus such as the apparatus shown in FIG. 1. It will be noted from the payout table in FIG. 6 that the alternate game may allow the player to choose the amount of the bet. The payout table lists the payouts for bets of between one and five "coins." Thus, the preferred apparatus includes means for allowing the player to choose their bet for playing a particular hand.

Referring to FIG. 7, the game begins with a first level play request it process block 70. A player may make this first level play request through a suitable input device such is the input device 16 shown in FIG. 1. In response to the first level play request, the first level game program code executing on the system retrieves a first level game record at process block 71 and causes the first level game representation associated with the retrieved record to be displayed to enable the player to view the first level game representation. In this illustrated form of the invention, the game representation comprises a representation of a five-card poker hand displayed on a device such as display 15 in FIG. 1.

Some first level game records may be associated with an immediate winning outcome. Such an immediate winning outcome is identified at process block 72. After identifying a record as having an immediate winning outcome, the process branches to process block 73 where the payout or prize is paid by any suitable arrangement associated with the gaming apparatus (10 in FIG. 1).

In addition to immediate winning outcomes, some first level game records may be associated with winning outcomes which are not readily apparent from the first level game representation. These "forced hold" first level game records are identified at process block 74. The process then branches to input block 75 where the player may make an input through the player input (16 in FIG. 1). In response to the player input, modified game representation program code causes a modified game representation to be displayed to the player. This step is shown at process block 76. The modified game representation is dictated by the outcome associated with the first level game record retrieved at step 71 in FIG. 7. After displaying the modified game representation, the gaming apparatus makes the appropriate payout as shown at process block 73.

If the first level game record is not associated with an immediate winning outcome or a "forced hold" winning outcome, the process proceeds to block 76. At this point in the gaming process, the player may use the player input device (16 in FIG. 1) to choose which cards in the first level game representation to hold and which to discard in favor of a draw. These actions by the player represent a second level play request. In this form of the invention, the cards which the player chooses to hold determines the particular second level game ill which the player will participate. Depending upon which cards the player has chosen to hold, the gaming apparatus (10 in FIG. 1) responds at process block 79 by the retrieving a second level game record from the appropriate second level game. For example, if the first level game representation associated with the first level game record retrieved at process block 71 includes a pair of jacks and if the player holds the jacks, the system at process block 79 retrieves a second level game record from the game entitled "draw to pair of jacks or better". The game representation associated with the retrieved second level game record is displayed at process block 80 and system then makes the indicated payout as indicated at block 73 in FIG. 7.

As mentioned above, an advantage of this alternate form of invention is that the player may choose to hold any subset of cards, even a subset which does not represent the optimum play. Each first level hand (game representation) will be associated with at least one optimum play. The optimum play is the play in which the held cards enter the player in a second level game having the highest average payout of all the second level games which may be entered through the first level hand. That is, the optimum play is the play to the hand with the highest expected value. The expected values of the various potential hands are shown in the prize structure table of FIG. 5. A suboptimum play is a play to a hand with an expected value lower than the expected value of the optimum play.

For purposes of example, assume that the first level game record outcome is "jacks or better" and that the first level game representation includes the jack of hearts, jack of clubs, ace of hearts, five of hearts, and two of hearts. This hand is associated with the game category "jacks or better." Also assume that the player is playing the "one coin" game. Referring to FIG. 5, the hand "jacks or better" has a nominal value of one dollar and thus would pay one dollar if the player elects to hold the entire hand and not take a draw. Also, the "jacks or better" hand has an expected value of 1.5 dollars. The player may choose to draw to the two jacks, thus participating in the second level game "draw to jacks or better." As shown in FIG. 8, the expected value represents the average value of the potential outcomes associated with the particular second level game. It will be noted that many categories of hands shown in FIG. 5 include a nominal value of zero and thus have no potential for a payout at the first level.

Although the example hand described above is associated with the "jacks or better" category, the alternate form of the invention allows the player to discard the jack of clubs and hold the four card flush comprising the jack of hearts, ace of hearts, five of hearts, and two of hearts. Holding the four card flush represents a second level play request in the second level game "draw to four card flush." Referring to FIGS. 5 and 9, the expected value of the "four card flush" hand is 1.25 dollars, lower than the play to the "jacks or better" hand. Thus, in this example, if the player draws to the four hearts, they are, in effect, foregoing winnings.

This alternate form of the invention accounts for suboptimum plays with a foregone winnings procedure which provides a credit for the amount that the player has given up by making the suboptimum play. This foregone winnings procedure is implemented by program code executed by the system. Referring to process block 81 in FIG. 7, the program code calculates a bonus escrow based on the particular play that the player has made at process block 78. This bonus escrow is equal to the expected value of the hand dictated by the first level record, minus the value of the hand to which the player has drawn. Where the player makes the optimum play, the bonus escrow will equal zero. However, in each instance where the player draws to the suboptimum hand, that is, makes the suboptimum play, the bonus escrow amount will be greater than zero.

The invention encompasses several methods for handling the bonus escrow or credited amount. One method is illustrated in FIG. 7. After the payout is made at process block 73, the process shown in FIG. 7 includes the step of checking the value of the bonus escrow at process block 82. If the bonus escrow is not greater than zero, then the game ends at process block 83. However, if the player has made a suboptimum play and thus the bonus escrow is greater than zero, the illustrated form of the invention proceeds to a third or bonus level game at process block 84. At block 84, the system retrieves a bonus level record and displays a bonus level game representation which indicates the outcome associated with the bonus game. This game may be related to poker or may be related to any other type of game such has a slot machine game for example. After displaying the bonus level game representation, the invention includes making any payout for the retrieved bonus level game record. The game then ends at process block 83 once any bonus level game payout is made at block 85.

The alternate form of the invention described above with reference to FIGS. 5 through 9 is similar to the previously described embodiments in that the game is made to resemble a casino-type game but is in fact made up of different levels of interrelated lottery-type games. Also, each second level game record is purchased with the value of the outcome associated with the particular first level game record which the player has received. However, the alternate implementation of the invention allows the player to make suboptimal choices in the play of the game. Thus, there may be a discrepancy between the value of a first level game record and the cost of a second level game record which a player has chosen. The bonus level game is introduced in the alternate form of the invention to account for this potential discrepancy.

It will be understood that the bonus level game is just one preferred method for applying the credit resulting from a suboptimum play. Rather than crediting the player having made the suboptimum play, either by entering the player in the bonus level game or otherwise, the bonus escrow amount may be credited to a jackpot in another game or may be credited in any other fashion. These and other bonus escrow crediting arrangements are to be considered equivalent to the illustrated bonus level game arrangement for the purposes of the following claims.

The above described preferred embodiments are intended to illustrate the principles of the invention, but not to limit the scope of the invention. Various other embodiments and modifications to these preferred embodiments may be made by those skilled in the art without departing from the scope of the following claims. For example, although it is an advantage of the invention that the gaming method may be implemented to mimic a casino-type game, the game representations which are displayed may be designed so that it is apparent to the player that they are playing lottery-type games. Also, although the invention is illustrated above with reference to poker and blackjack related games, the game representations according to the invention may be designed to imitate other types of casino games or any other type of game.

What is claimed is:

1. A gaming method comprising the steps of:

(a) developing a plurality of first level game records for a first level game, each first level game record including a predetermined first level game outcome;

(b) developing a plurality of second level game records for a second level game, each second level game record including a predetermined second level game outcome, the second level game being related to a first level negotiable outcome which comprises the first level outcome of at least one game record of the first level game;

(c) enabling a game player to view a first level game representation associated with a particular one of the first level game records; and (d) where the first level game outcome of the particular one of the first level game records comprises the first level negotiable outcome, enabling the player to view a second level game representation associated with a particular one of the second level game records, the second level game representation indicating the predetermined second level game outcome of the particular one of the second level game records and being related to the first game level representation by a common representation portion.

2. The method of claim 1 further comprising the step of:

(a) developing a plurality of game records for a plurality of additional level games, each game record for each additional level game including a predetermined additional level game outcome indicated by an additional level game representation, each additional level game representation being related to a negotiable outcome available in an immediately preceding level game.

3. The method of claim 1 further comprising the step of:

(a) developing a plurality of additional second level game records for each of a plurality of additional second level games, each additional second level game record including a predetermined additional second level game outcome indicated by an additional second level name representation, and each additional second level game representation being related to an additional first level negotiable outcome available in at least one game record of the first level game.

4. The method of claim 1 wherein:

(a) the steps of developing a plurality of first level game records and developing a plurality of second level game records are performed at a game manufacturing processor;

(b) the step of enabling the game player to view the first level game representation comprises displaying the first level game representation at a player terminal in response to a first level play request; and (c) the step of enabling the game player to view the second level game representation comprises displaying the second level game representation at the player terminal in response to a second level play request.

5. The method of claim 4 further comprising the steps of:

(a) transferring the first level game representation from a game record storage to the player terminal in response to the first level play request, and (b) transferring the second level game representation from the game record storage to the player terminal in response to the second level play request.

6. The method of claim 4 further comprising the step of:

(a) generating the first level game representation in response to the first level play request, the generation of the first level game representation being dictated by the first level outcome of the particular one of the first level game records.

7. The method of claim 6 further comprising the step of:

(a) generating the second level game representation in response to the second level play request, the generation of the second level game representation being dictated by the second level outcome of the particular one of the second level game records.

8. The method of claim 6 further comprising the step of:

(a) where the first level game outcome of the particular one of the first level game records enables the player to view a modified game representation in response to a player input, the modified game representation being dictated by the first level game outcome of the particular one of the first level game records.

9. The method of claim 1 wherein:

(a) each first level game record is associated with an expected value and with a game category representing an optimum player response to the first level game record, the expected value comprising a value based on the optimum player response to the first level game record.

10. The method of claim 9 further comprising the steps of:

(a) developing a plurality of bonus level game records for a bonus level game, each bonus level game record including a bonus level game outcome, and (b) where the player chooses a suboptimal game record response, enabling the player to participate in the bonus level game.

11. The method of claim 9 further comprising the step of:

(a) providing a credit comprising the difference between the expected value associated with the particular one of the first level game records and a value associated with a suboptimal game record response.

12. The method of claim 2 wherein each game record of at least one additional level game is associated with an expected value and with a game category representing an optimum player response to said additional level game record, the expected value comprising a value based on an optimum player response to said additional level game record.

13. The method of claim 1 wherein the first level game representation is a representation of a casino-type game.

14. A gaming apparatus comprising:

(a) a game record storage device for (i) storing a plurality of first level game records for a first level game, each first level game record including a first level game outcome, and for (ii) storing a plurality of second level game records for a second level game, each second level game record including a second level game outcome, the second level game being related to a first level negotiable outcome which comprises the first level game outcome of at least one game record of the first level game;

(b) a player terminal having a player input arrangement;

(c) a communication arrangement for facilitating communications between the game record storage device and the player terminal; and (d) a play control arrangement for (i) causing the player terminal to display a first level game representation associated with a particular one of the first level game records, the first level game representation being displayed in response to a first level play request initiated at the player terminal, and (ii) where the game outcome of the particular one of the first level game records comprises the first level negotiable outcome, for causing the player terminal to respond to a second level play request initiated at the player terminal, the player terminal responding by displaying a second level game representation associated with a particular second level game record, the second level game representation being related to the first level game representation by a common representation portion.

15. The gaming apparatus of claim 14 wherein the play control arrangement includes:

(a) a game retrieval arrangement for (i) retrieving the first level game representation from the game record storage device, and for (ii) retrieving the second level game representation from the game record storage device.

16. The gaming apparatus of claim 14 wherein the play control arrangement includes:

(a) a game representation generation arrangement for (i) generating the first level game representation based upon the first level game outcome associated with the particular one of the first level game records, and for (ii) generating the second level game representation based upon a second level game outcome associated with the particular second level game record.

17. The gaming apparatus of claim 14 wherein the play control arrangement includes:

(a) a game representation modification arrangement for causing the player terminal to display a modified game representation in response to a player input when the first level game outcome comprises an after draw winning outcome.

18. A program product adapted to be executed by a processor associated with a game player terminal, the program product being stored on a computer readable medium and comprising:

(a) first game level program code for responding to a first level play request by causing the player terminal to display a first level game representation associated with a particular one of a plurality of first level game records for a first level game, each one of the plurality of first level game records including a first level game outcome; and (b) second game level program code for responding to a second level play request when the first level game outcome associated with the particular one of the plurality of first level game records comprises a first level negotiable outcome, the second game level program code responding by causing the player terminal to display a second level game representation associated with a particular one of a plurality of second level game records for a second level game and related to the first level game representation by a common representation portion, each one of the plurality of second level game records including a second level game outcome.

19. The program product of claim 18 wherein:

(a) the first game level program code includes first game level retrieval code for retrieving the first level game representation from a game record storage device; and (b) the second game level program code includes second game level retrieval code for retrieving the second level game representation from the game record storage device.

20. The program product of claim 18 wherein:

(a) the first game level program code includes first level game representation program code for generating the first level game representation, and (b) the second game level program code includes second level game representation program code for generating the second level game representation.

21. The program product of claim 18 further comprising:

(a) game modification program code for causing the player terminal to display a modified game representation in response to a player input when the first level game outcome of the particular one of the first level game records comprises after draw winning outcome, the modified game representation being related to the after draw winning outcome.

22. The program product of claim 18:

(a) wherein each first level game record is associated with an expected value and with a game category representing an optimum player response to the first level game record, the expected value comprising a value based on (he optimum player response to the first level game record; and (b) further comprising foregone winnings program code for providing a credit comprising the difference between the expected value associated with the particular one of the first level game records and a value associated with a suboptimal game record response.

23. A gaming method comprising the steps of:

(a) enabling a game player to view a first level game representation associated with a particular one of a plurality of first level game records, the first level game representation indicating a predetermined first level game outcome of the particular one of the first level game records; and (b) where the first level game outcome of the particular one of the first level game records comprises a first level negotiable outcome, enabling the player to view a second level game representation associated with a particular one of a plurality of second level game records, the second level game representation indicating a predetermined second level game outcome of the particular one of the second level game records and being related to the first game level representation by a common representation portion.

24. The method of claim 23 including the step of:

(a) where the second level game outcome of the particular one of the second level game records comprises a second level negotiable outcome, enabling the player to view an additional level game representation associated with a particular one of a plurality of additional level game records, the additional level game representation indicating a predetermined additional level game outcome of the particular one of the additional level game records and being related to the first game level representation by a common representation portion.

* * * * *

UNITED STATES PATENT AND TRADEMARK OFFICE

CERTIFICATE OF CORRECTION

PATENT NO. : 6,220,961 B1
DATED : April 24, 2001
INVENTOR(S) : Keane, et al.

It is certified that error appears in the above-identified patent and that said Letters Patent is hereby corrected as shown below:

Column 7,
Line 56, change "alter-draw" to -- after-draw --.

Column 12,
Line 26, change "Door" to -- For --.

Column 19,
Line 21, change "(he" to -- the --.

Signed and Sealed this

Thirteenth Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,220,961 B1
DATED : April 24, 2001
INVENTOR(S) : Keane et al.

It is certified that error appears in the above-identified patent and that said Letters Patent is hereby corrected as shown below:

Column 16,
Line 45, change “name” to -- game --.

Signed and Sealed this

First Day of April, 2003

JAMES E. ROGAN
*Director of the United States Patent and Trademark Office*